United States Patent [19]

Stendal

[11] Patent Number: 4,697,442

[45] Date of Patent: Oct. 6, 1987

[54] LOCK

[76] Inventor: Karl-Emil Stendal, Tvärpilsgatan 15, S-723 53 Västerås, Sweden

[21] Appl. No.: 864,759

[22] PCT Filed: Oct. 18, 1982

[86] PCT No.: PCT/SE82/00335

§ 371 Date: Jun. 20, 1983

§ 102(e) Date: Jun. 20, 1983

[87] PCT Pub. No.: WO83/01478

PCT Pub. Date: Apr. 28, 1983

Related U.S. Application Data

[63] Continuation of Ser. No. 514,821, Jun. 20, 1983, abandoned.

[30] Foreign Application Priority Data

Oct. 19, 1981 [SE] Sweden ..... 8106166

[51] Int. Cl.[4] ..... E05B 65/08

[52] U.S. Cl. ..... 70/97; 70/417; 292/201; 292/346

[58] Field of Search ..... 292/302, 304, 332–336, 292/DIG. 46, DIG. 47, 201, 346, DIG. 51, 279, 282, 300, 301, 303; 70/97, 136, 157, 417, 418, 99–100

[56] References Cited

U.S. PATENT DOCUMENTS

| | | | |
|---|---|---|---|
| 109,220 | 11/1870 | Kehoe | 70/97 |
| 888,285 | 5/1908 | Wibel et al. . | |
| 987,043 | 3/1911 | Buday . | |
| 1,417,430 | 5/1922 | Tulloch et al. . | |
| 1,768,021 | 6/1930 | Bauerband . | |
| 1,880,850 | 10/1932 | Dautrick . | |
| 2,103,989 | 12/1937 | Machinist | 70/DIG. 57 X |
| 2,313,416 | 3/1943 | Young . | |
| 2,898,138 | 8/1959 | Van Noord | 292/201 X |
| 2,923,145 | 2/1960 | Labrie . | |
| 2,934,370 | 4/1960 | Love et al. | 292/302 X |
| 3,002,365 | 10/1961 | Liljequist | 292/302 X |
| 3,157,698 | 10/1964 | Pollock | 292/302 X |
| 3,269,058 | 8/1966 | Lynn et al. . | |
| 3,337,250 | 8/1967 | Russell et al. . | |
| 3,731,506 | 5/1973 | Greene et al. | 70/97 |
| 3,831,408 | 8/1974 | Featherman | 70/279 X |
| 4,082,078 | 4/1978 | Thuleen et al. | 292/201 X |
| 4,088,354 | 5/1978 | Kolendowicz | 292/201 |
| 4,117,700 | 10/1978 | Saunders | 70/DIG. 57 X |
| 4,322,959 | 4/1982 | Mochida | 70/282 X |
| 4,363,229 | 12/1982 | Baitz | 70/279 |
| 4,406,487 | 9/1983 | Stendal . | |
| 4,470,625 | 9/1984 | Walsh et al. | 292/201 |

FOREIGN PATENT DOCUMENTS

| | | | |
|---|---|---|---|
| 2411750 | 9/1974 | Fed. Rep. of Germany . | |
| 37290 | 11/1930 | France | 70/97 |
| 1498005 | 1/1978 | United Kingdom . | |

*Primary Examiner*—Robert L. Wolfe

*Attorney, Agent, or Firm*—Burns, Doane, Swecker & Mathis

[57] ABSTRACT

Lock for overhead doors an similar. The lock comprises a stationary part in the form of a lock housing (10) having a tubular lock sleeve (17) which is parallel with the direction of movement of the door, and a movable part which comprises a lock plunger (13) arranged to enter into the lock sleeve when the door is closed, and in the lock housing a lock latch (10) arranged to be brought into engagement with the plunger and to prevent the extraction of the plunger from the lock sleeve.

15 Claims, 4 Drawing Figures

FIG. 2
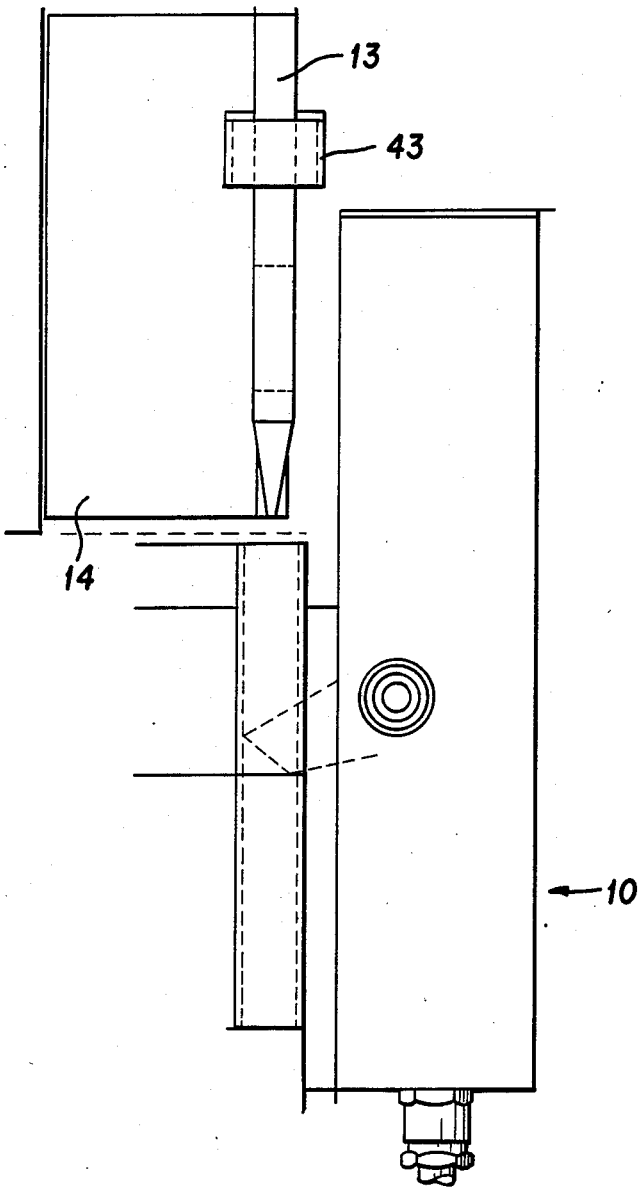
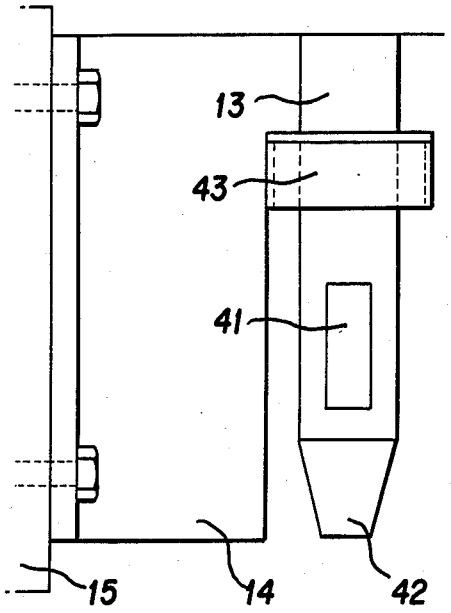
FIG. 3

LOCK

This application is a continuation of application Ser. No. 514,821, filed June 20, 1983 and now abandoned.

The present invention relates to a lock mechanism for vertically sliding overhead doors, gates and similar. There are at present no satisfactory locking means for overhead gates because of the great play involved between the door and the door post sideways as well as backwards and forwards. A lock having a lock latch of conventional type can therefore not advantageously be used.

The invention solves this problem by a design of the locking device such that the stationary part of the lock, including a movable latch is provided with a tubular lock sleeve which is parallel with the direction of movement of the door, the movable part of the lock having a lock plunger or lock bar adapted to enter into the lock sleeve on closing of the gate for locking engagement with the latch.

In connection herewith the play between the lock plunger and the lock sleeve is sufficiently great to cover the lateral play occurring in vertically sliding overhead doors. Furthermore the free end of the lock plunger can be given a tapering shape for guiding the plunger into the sleeve, thus extending the lateral range of the sleeve for cathing up the plunger.

The latch is suitably operated by an electric magnet, and there may also be an electric limit switch mounted on the latch. The switch closes when the latch is in locking position if at the same time the plunger is inserted into the the sleeve, i.e. if the sliding gate is closed. The contact in the limit switch induces a signal which can be used for indicating purposes or for initiating a burglar alarm.

The lock mechanism is furthermore designed such that the door or gate can be closed independently of whether the lock magnet is under tension or not. For releasing the plunger and opening the gate is, however, normally required that the lock magnet is put under tension. The lock may as an alternative be provided with a manual key lock for mechanical releasing of the lock.

An embodiment of the invention is described more closely in the following specification with drawings showing the following.

Figure 1:
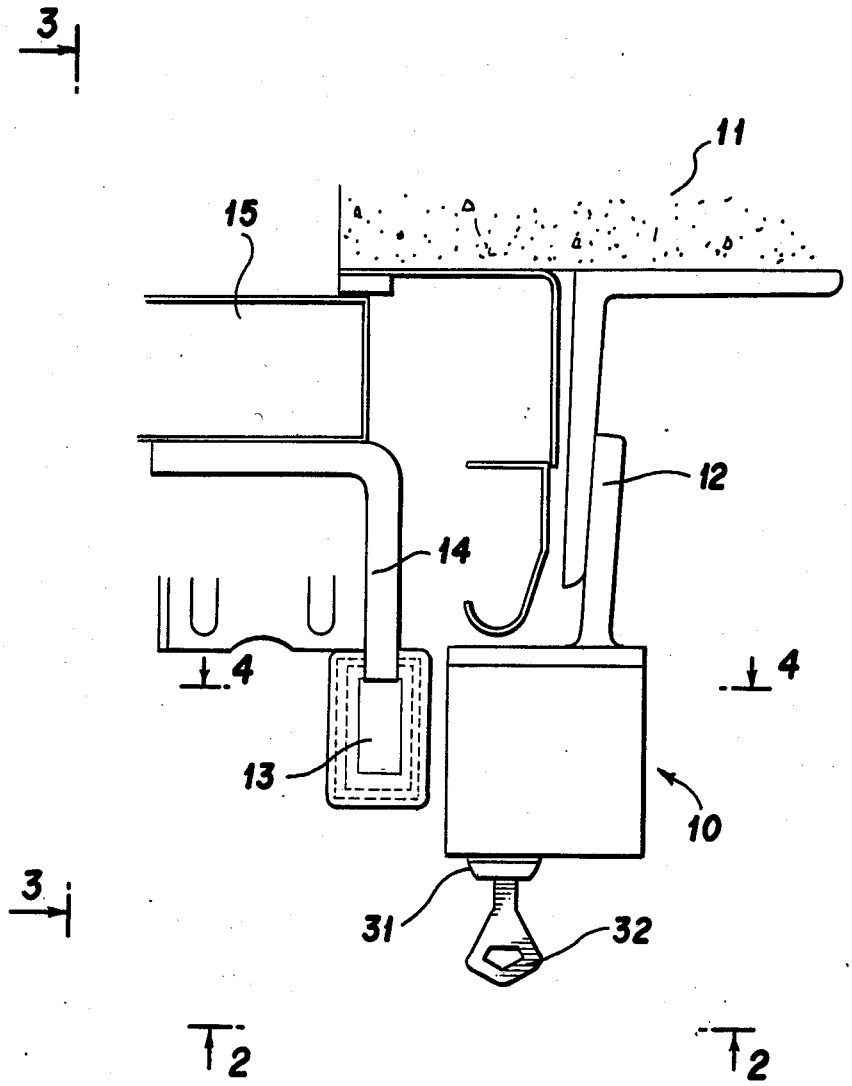

FIG. 1, a view from above of a lock according to the invention with portions of the door and the wall included.

FIG. 2, a side view in the direction 2—2 in FIG. 1.

FIG. 3, a side view of the lock plunger with fastening seen in the direction 3—3 in FIG. 1.

Figure 4:
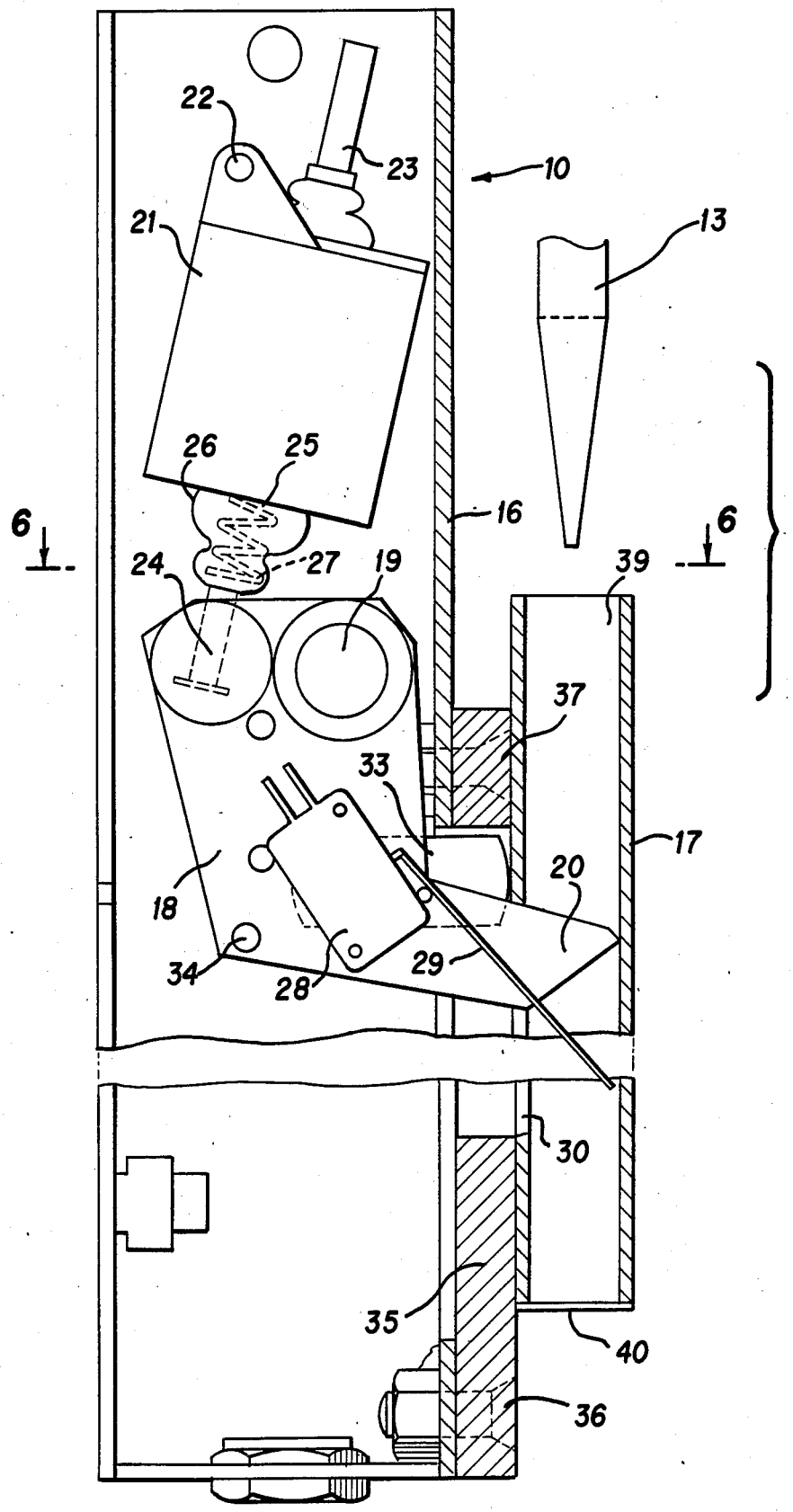

FIG. 4, a vertical section on a larger scale on the line 4—4 in FIG. 1.

FIG. 5, a side view of the lock housing on the same scale as in FIG. 4 seen in the direction 5—5 in FIG. 6.

FIG. 6, a cross section on the same scale as in FIG. 4 on the line 6—6 in FIG. 4.

The lock according to the invention is shown in survey views in FIGS. 1-3 showing the position of the different parts of the lock in relation to a door or gate and the wall or the door frame in which the door is mounted. As always the lock comprises a stationary part mounted in the frame of the door and a movable part mounted in the door, said parts being adapted for mutual locking engagement. The stationary part of the lock comprises in the present embodiment a lock housing 10 which is carried by the wall 11 by means of a support 12, for instance the frame of the door. The movable part of the lock comprises a lock plunger or lock bar 13, which by means of a bracket 14 is attached to the door 15.

Closer details of the lock housing are shown in FIG. 4. The housing is composed of a cover 16 and a lock sleeve 17. In the cover there is a lock latch 18 pivotally mounted on a lug 19 and having a projection 20 adapted to protrude into the lock sleeve 17 when the latch 18 takes the position shown in FIG. 4. The latch is operated by means of an electrical magnet 21 Which can pivot on a lug 22. The anchor 23 of the magnet is connected to the latch by a joint 24. A spring 25, situated within a protective cover 26 and therefor shown by dashed lines, is adapted to act between the coil 21 of the magnet and a flange 27 on the anchor, so that the anchor is urged downwards in FIG. 4 and holds the latch in the position shown in the drawing. The proper weight of the latch 18 cooperates for this purpose with the spring 25. The magnet is adapted to pull the anchor upwards, turning the latch inwards into the lock housing when the magnet current is switched on. A limit switch 28 is attached to the latch and is provided with a feeler arm 29 which projects into the lock sleeve 17 through the side opening 30, when the latch takes the position shown in FIG. 4.

The latch may alternatively be operated by means of a conventional manual lock 31 which is controlled by means of a key 32. The lock 31 is provided with a pivoting projection 33, which is arranged to be pivoted by means of the key and to act on a lug 34 on the latch so that the latch is retracted from the position shown in FIG. 4 against the action of the spring 25 and the proper weight of the latch.

The lock sleeve 17 is shown in side view in FIG. 5. It is rigidly attached to a support plate 35 which is fastened to the lock housing by means of lower screws 36 and upper screws 37. The upper screws have their heads situated inside the lock sleeve 17 and are tightened by entering a screw driver through holes 38 in the outer wall of the lock sleeve situated opposite to the screws 37. The lock sleeve is open upwards at 39 and has a bottom 40 at its lower end.

The lock plunger 13 appears most clearly from FIGS. 2 and 3. As shown in FIG. 2 the plunger is arranged to enter the lock sleeve when the door moves in its closing direction. The plunger has a through hole 41 extending transversely into which the latch is adapted to enter. At its lower end the plunger is tapering in order to facilitate the insertion of the plunger into the lock sleeve. At its upper end the plunger is provided with an umbrella-shaped collar 43 which in closed position of the lock embraces the upper opening of the lock sleeve.

In the described device the lock latch 18 is held in its open position by switching on the electromagnet 21. The latter is adapted to be continuously switched on with for instance a 24 V and 0.54 A direct current. In its open position the projection 20 of the latch 18 is retracted from the sleeve 17 and leaves thus free passage for the plunger 13 into and out of the sleeve 17.

If the electromagnet is switched off, the latch 18 is swung by its proper weight and by the spring 25 to the position shown in FIG. 4, in which the projection 20 protrudes into the sleeve 17 from the side. If the door in this position of the lock should be open and the plunger 13 thus should be positioned above the sleeve 17, the door can nevertheless be closed, as the latch 18 due to its pivoting attachment on the lug 19 can be cammed away by the plunger when the latter moves downwards into the sleeve. When the plunger reaches its bottom position the latch snaps back to the locking position in FIG. 4, the projection 20 entering into the opening 41 in the plunger. After that the door cannot be opened as long as the latch remains in the locking position, because the upper edge of the opening 30 prevents the latch 18 from being pivoted upwards, and moreover the lower surface of the projection 20 is directed circumferentially to the pivot centre 19, so that an upward pressure from the plunger on the projection 20 will act substantially towards the pivot.

In the locked position of the plunger the plunger holds the feeler arm 29 swung aside, thus acting on the switch 28, which is connected to a lamp or some other signal on a conrol panel indicating that the door is closed and locked. If the door should be only closed but not locked, i.e. the latch 18 retracted inwards, the feeler arm 29 is swung into the lock housing together with the latch and the plunger 13 will not actuate the switch 28.

The manual lock 31 makes it possible to open the door independently of the electric system and the electromagnet 21. This can be important for instance in case of power failure, as it otherwise would be impossible to open a closed door. Certain of the described details serve especially to prevent unauthorized opening of the lock. The collar 43 and the bottom 40 thus prevent entering of a tool into the lock sleeve 17 in order to push the latch aside. The position of the screws 37 at the inner wall of the lock sleeve means that the screw heads are covered by the plunger when the door is closed, so that no one can unscrew the lock sleeve 17 from the cover 16 of the lock housing. Also in other aspects the construction is robust and suitable for resisting unauthorized opening. The cover 16 of the lock housing and the sleeve 17 are made of a rolled, square tube profile having a thick wall. Furthermore the mechanism is simple with few and simple movable parts, which renders a destruction of the lock difficult.

I claim:

1. A locking device for vertically moving sliding gates which travel within a frame, comprising a lock mechanism including a lock housing and a lock bar, said lock housing including a sleeve having a closed end and an opposed opening oriented toward said lock bar and being arranged to receive the lock bar, the lock mechanism bridging a space between and adjacent to an edge of the gate positioned in the direction of movement of the gate and being substantially parallel to an adjacent edge of the frame, said sleeve being positioned on a projection extending from the edge of the frame and said lock bar being positioned on a projection extending from the adjacent edge of the gate, the edges of said frame and said gate maintaining a substantially fixed separation distance throughout movement of the gate, said housing have a latch, said latch being resiliently urged into a position protruding into said sleeve and being of a construction sufficient to permit said lock bar to enter said opening in said sleeve thus permitting closing of said gate, and simultaneously limiting extraction of said lock bar from said sleeve thus limiting opening of said closed gate, said latch protruding into said sleeve in a direction substantially perpendicular to the direction of locking engagement with the lock bar, wherein said sleeve includes a mouth having sides which are tubular at least along an inner surface thereof, and said lock bar having a collar which, when the gate is moved vertically downward, the lock bar is moved along a substantially vertical path generally parallel to the frame and said sleeve for insertion into said sleeve, said lock bar embracing all of said sides of said mouth of said sleeve and extending at least a short distance beyond said sides of said sleeve, and, along with said closed end of said sleeve, prevents insertion of a tool into said sleeve for pushing aside said latch.

2. The locking device as defined in claim 1, wherein a limit switch is mounted on said latch and is provided with sensing means for detecting whether said lock bar is inserted into said sleeve.

3. The locking device as defined in claim 1 wherein said sleeve is a separate tube connected to said housing.

4. The locking device as defined in claim 3, wherein said sleeve is attached to said housing with fastening means which, when said lock bar is removed from said sleeve, are accessible through at least one opening formed in a wall positioned opposite said sleeve, said fastening means being inaccessible through said at least one opening when said bar is inserted into said sleeve.

5. The locking device as defined in claim 3, wherein said tube and said bar have a quadrangular flat cross section, and wherein said bar includes a passage for receiving said latch.

6. The locking device as defined in claim 1, wherein said bar includes a tapered fore end.

7. The locking device as defined in claim 1, wherein said latch is rotatably journalled on a lug.

8. The locking device as defined in claim 1, further comprising an electromagnet for moving said latch.

9. The locking device as defined in claim 8, further comprising a spring for maintaining said latch in a locked position, wherein said electromagnet moves said latch to an open position.

10. The locking device as defined in claim 8, further comprising a manual key lock for reciprocally moving said latch as an alternate to the electromagnet.

11. The locking device as defined in claim 2, wherein said sleeve is a separate tube connected to said housing.

12. The locking device as defined in claim 11, wherein said sleeve is attached to said housing with fastening means which, when said lock bar is removed from said sleeve, are accessible through at least one opening formed in a wall positioned opposite said sleeve, said fastening means being inaccessible through said at least one opening when said bar is inserted into said sleeve.

13. The locking device as defined in claim 4, wherein said tube and said bar have a quadrangular flat cross section, and wherein said bar includes a passage for receiving said latch.

14. The locking device as defined in claim 11, wherein said tube and said bar have a quadrangular flat cross section, and wherein said bar includes a passage for receiving said latch.

15. The locking device as defined in claim 9, further comprising a manual key lock for reciprocally moving said latch as an alternate to the electromagnet.

* * * * *